US008094174B2

(12) United States Patent
Chen et al.

(10) Patent No.: US 8,094,174 B2
(45) Date of Patent: Jan. 10, 2012

(54) SYSTEMS FOR THERMAL PATTERNING

(75) Inventors: Ying-Chi Chen, Hsinchu (TW); Chao-Hsu Tsai, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 139 days.

(21) Appl. No.: 12/506,873

(22) Filed: Jul. 21, 2009

(65) Prior Publication Data

US 2010/0085411 A1 Apr. 8, 2010

(30) Foreign Application Priority Data

Oct. 3, 2008 (TW) ..... 97138183 A

(51) Int. Cl.
*B41J 25/308* (2006.01)

(52) U.S. Cl. ..... 347/198

(58) Field of Classification Search ..... 347/197, 347/198; 400/120.16
See application file for complete search history.

(56) References Cited

U.S. PATENT DOCUMENTS 4,973,986 A * 11/1990 Narita ..... 347/201
6,498,679 B2 12/2002 Lee et al.

FOREIGN PATENT DOCUMENTS

CN 1343572 A 4/2002
CN 101177072 A 5/2008

OTHER PUBLICATIONS

Translation of CN 1343572, published on Apr. 2002.*

* cited by examiner

*Primary Examiner* — Huan Tran

(57) ABSTRACT

Systems for thermal patterning are presented. The system includes a thermal print head module. The thermal print head module includes at least one point heater. An elastic adjustable device is used for adjusting the flatness of the thermal print head module. A rotation adjustable device is used for controlling the thermal print head module to rotate with a predetermined angle.

14 Claims, 7 Drawing Sheets

SYSTEMS FOR THERMAL PATTERNING

CROSS REFERENCE TO RELATED APPLICATIONS

This application is based upon and claims the benefit of priority from a prior Taiwanese Patent Application No. 097138183, filed on Oct. 3, 2008, the entire contents of which are incorporated herein by reference.

BACKGROUND OF THE INVENTION

1. Field of the Invention

The invention relates to a system for thermal patterning.

2. Description of the Related Art

Display panels have been developed towards large scale and flexible regimes. In order to achieve fast and precise production, conventional fabrication methods for patterned structures include lithography, laser processing, inkjet printing, and thermal print-heat patterning.

Conventional lithography is beneficial due to the fact that its well-developed. However, fabrication method using lithography is complicated and expensive. Further, $CO_2$ laser processing is advantageous due to the fact that it can be practically used. A pattern is created by several laser-scanning lines such that fine traces are left between the laser-scanning lines. However, production throughput is very slow. Additionally, quality is not easy to control due to unstable laser sources. Meanwhile, inkjet printing is beneficial due to low production costs. Inkjet droplets, however, are not easily applied on some materials. Additionally, pattern quality is unstable due to volatile inkjet droplets and crooked ink trajectory.

U.S. Pat. No. 6,498,679, the entirety of which is hereby incorporated by reference, discloses a fabrication method for patterning phase retardation using $CO_2$ laser heating. Patterns with different phase retardation characteristics are formed by laser scanning line by line. Several laser-scanning lines are composed on a patterned region.

FIG. 1 is a schematic view illustrating a layer-by-layer structure of a conventional micro retarder. Referring to FIG. 1, a phase retarder 14 includes a hatched area 14*b* and a blank area 14*a* with different phase retardations in which the hatched area 14*b* is the area exposed to the infra-red $CO_2$ laser, while the blank area 14*a* is not processed by the infra-red laser. Typically, the hatched area with zero phase retardation and the blank area with the phase retardation are produced by an alternating heating treatment alternating. Both surfaces of the micro-retarder 14 are covered by the layer of index matching glue and the protection layer 10 and 12, and 16 and 18 laminations, respectively. However, laser-scanning lines that produce the hatched area 14*b* contain fine traces and bubbles.

BRIEF SUMMARY OF THE INVENTION

An embodiment of the invention provides a system for thermal patterning, comprising: a thermal print head module equipped with at least one point heater; an elastic adjustable device for adjusting the flatness of the thermal print head module; and a rotation adjustable device for controlling the thermal print head module to rotate with a predetermined angle.

Another embodiment of the invention provides a system for thermal patterning, comprising: a thermal print head module encapsulating a passivation layer, wherein the thermal print head module is equipped with at least one point heater; an elastic adjustable device for adjusting the flatness of the thermal print head module; and a rotation adjustable device for controlling the thermal print head module to rotate with a predetermined angle.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
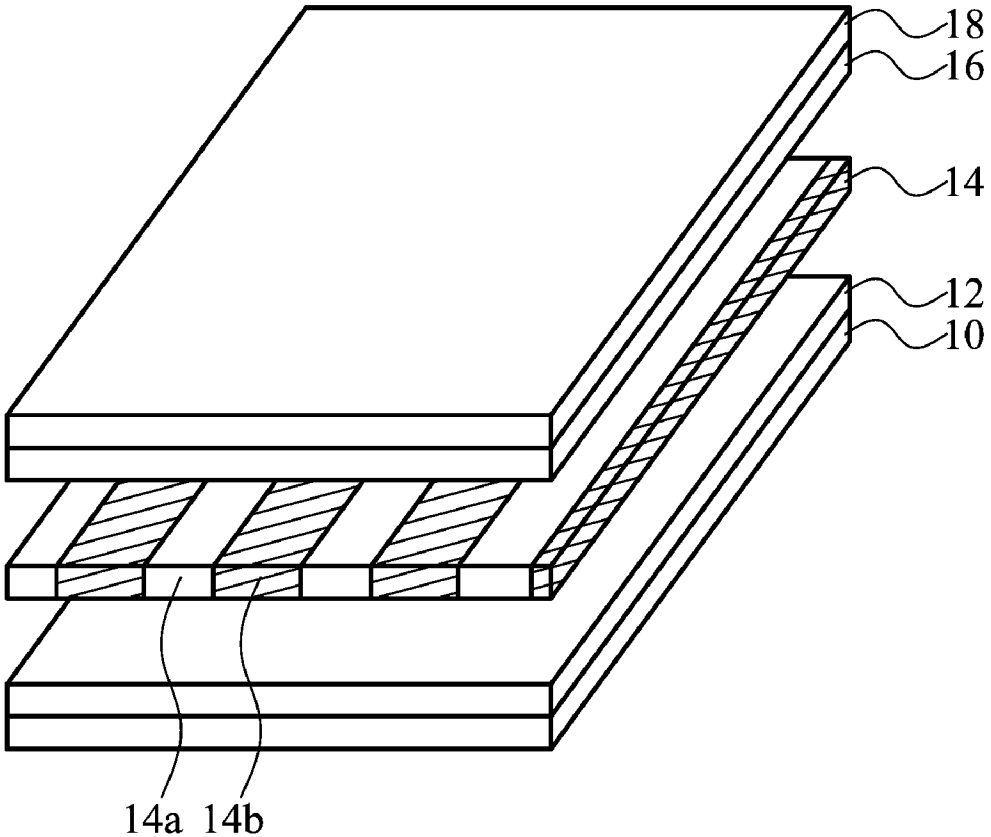
FIG. 1 ( RELATED ART )
FIG. 1 is a schematic view illustrating a layer-by-layer structure of a conventional micro retarder.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself indicate a relationship between the various embodiments and/or configurations discussed. Moreover, the formation method for a first feature over or on a second feature in the description that follows may include embodiments in which the first and second features are formed in direct contact or not in direct contact.

Embodiments of the invention provide thermal patterning techniques applied to large scale flexible substrates and large scale display regimes. The thermal patterning techniques in embodiments of the invention form patterned flexible substrate structures and display panels using a thermal patterning system.

Figure 2:
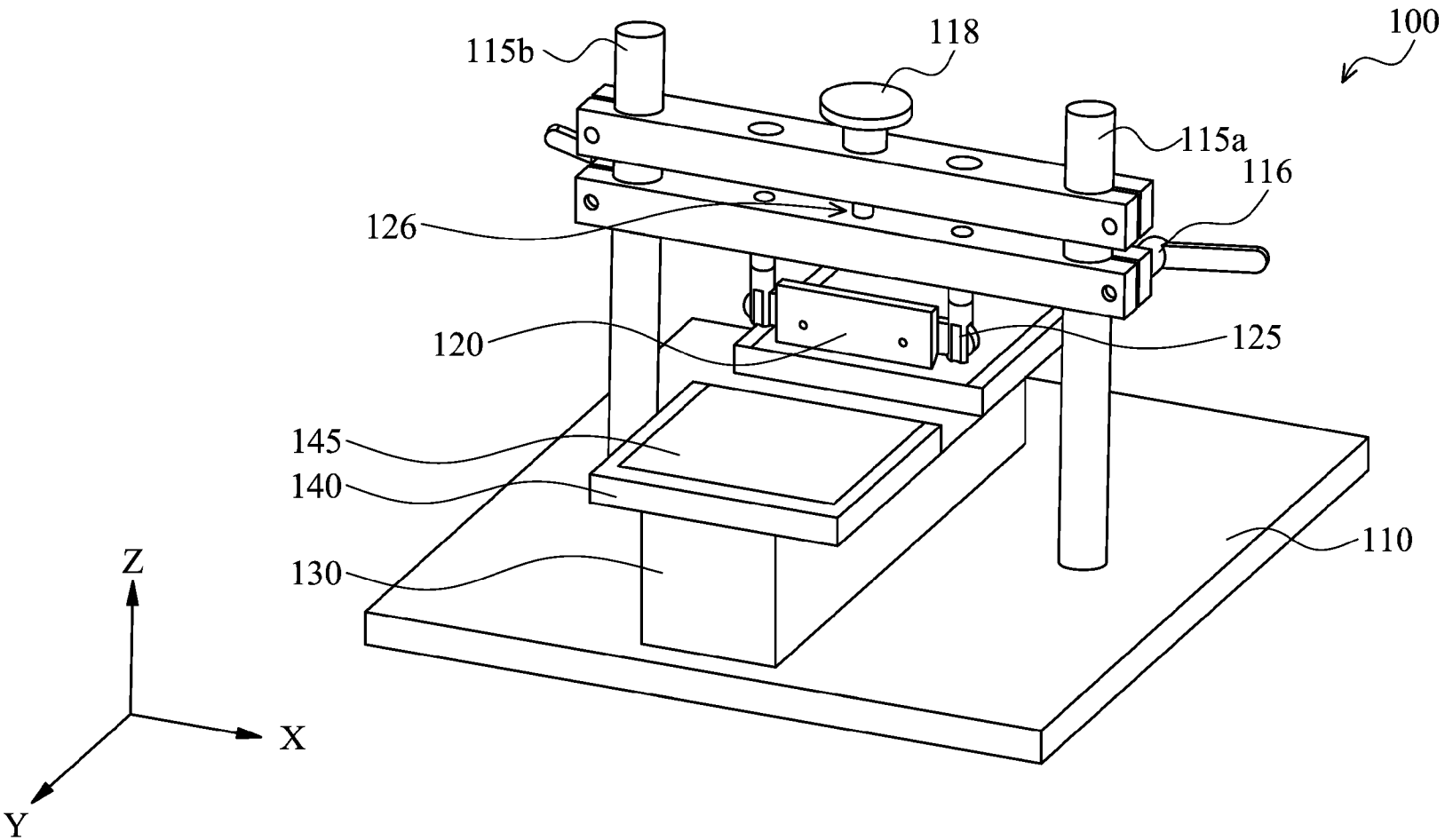
FIG. 2 is a schematic view of an embodiment of a thermal patterning system of the invention.

FIG. 2 is a schematic view of an embodiment of a thermal patterning system of the invention. Referring to FIG. 2, a thermal patterning system 100 includes a support stage 130 disposed on a base 110. The support stage 130 adopts a motor with precision bearings to precisely control movement of a thermal patterning platform 140 for thermal patterning. A desired patterned working piece (such as a substrate or a film) is fixed to the thermal patterning platform 140. A transverse beam is set up to a pair of vertical shafts 115*a* and 115*b* and fixed by a height adjusted means 116. A thermal print head module 120 is setup and fixed underlying the transverse beam to micro-contact with the desired patterned working piece on the thermal patterning platform 140. The contact condition between the thermal print head module 120 and the desired patterned substrate or film can be adjusted and fine-tuned by an automatic horizontal adjusted means 125. Alternatively, a rotation adjustable device 126 can be setup above the transverse beam for controlling the thermal print head module to rotate with a predetermined angle. The thermal patterning system 100 further comprises a micro-processor and a controller (not shown) to control output of the thermal print head module 120.

According to one embodiment of the invention, the thermal patterning system 100 includes means for adjusting a relative location (along z-axis) between the desired patterned working pieces (such as a material layer on the substrate) and the multiple thermal writing head set 120. The horizontal surface of the multiple thermal writing head set 120 can be automatically adjusted by the adjusted means 125. When patterning, the desired patterned working pieces can be held on the thermal patterning platform 140. The desired patterned working pieces on the thermal patterning platform 140 is addressed and controlled by the motor with precision bearings. When the desired patterned working pieces are conveyed by the motor with precision bearings, the working pieces are fixed on the thermal patterning platform 140, thereby achieving excellent patterned structures.

Other embodiments of the thermal print head module 120 of the invention uses special circular thermal writing heads arranged in a linear heater line. Each circular thermal writing head can precisely concentrate energy on the desired patterned display panels or flexible substrates. Above the thermal print head module, a vertical height adjustable means 118 or an elastic adjustable means (indicated as 128*b* in FIG. 3C) is disposed to adjust and maintain the distance between the thermal writing head module and the desired patterned working pieces such as display panels or flexible substrates. Additionally, the conveying speed of the desired patterned working pieces can be controlled to change temperature which is applied on the working pieces. Thus, large scale printing is realized, as multiple writing points of the thermal print head module are achieved through designing a suitable thermal print head module. The heating energy provided by each thermal writing head of the thermal writing head module is stable and concentrated such that the thermal writing head can be very close to the desired patterned working pieces. Printed structures with clear fringes can thus be achieved.

Figure 3A:
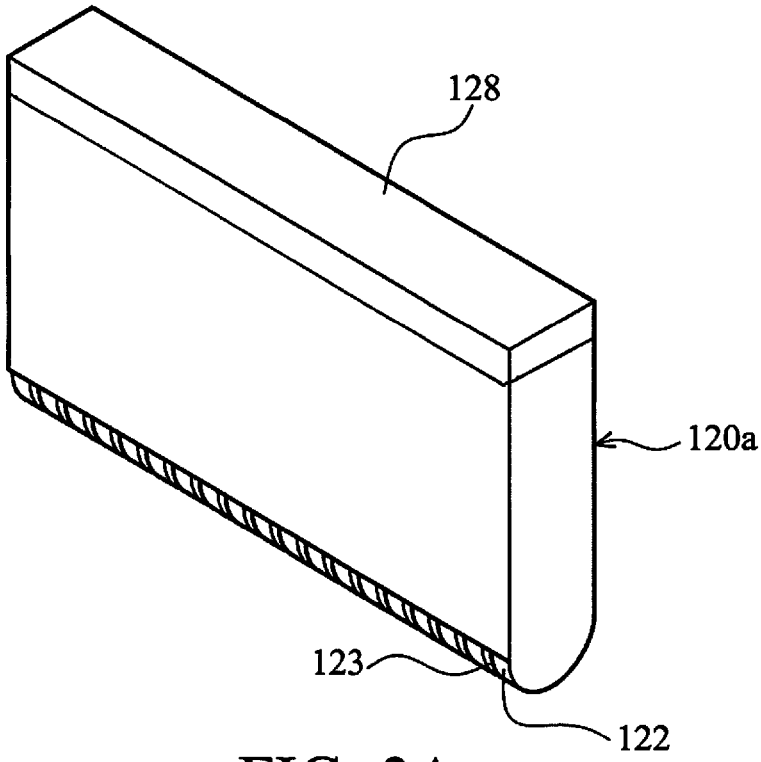
FIG. 3A is a schematic view of an embodiment of a thermal print head module of the invention.
Figure 3B:
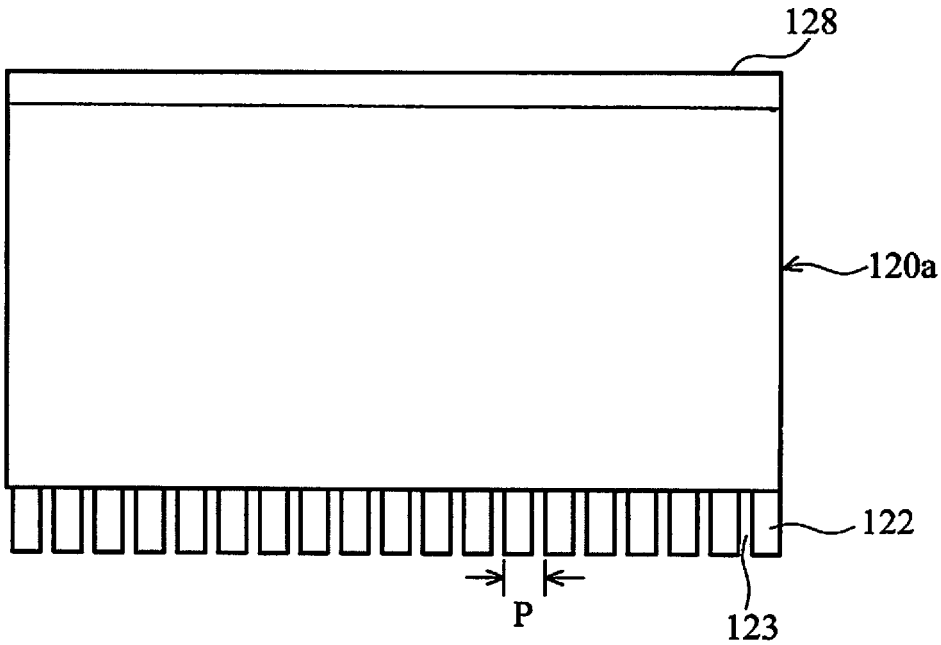
FIG. 3B is a cross section of the thermal print head module of FIG. 3A.
Figure 3C:
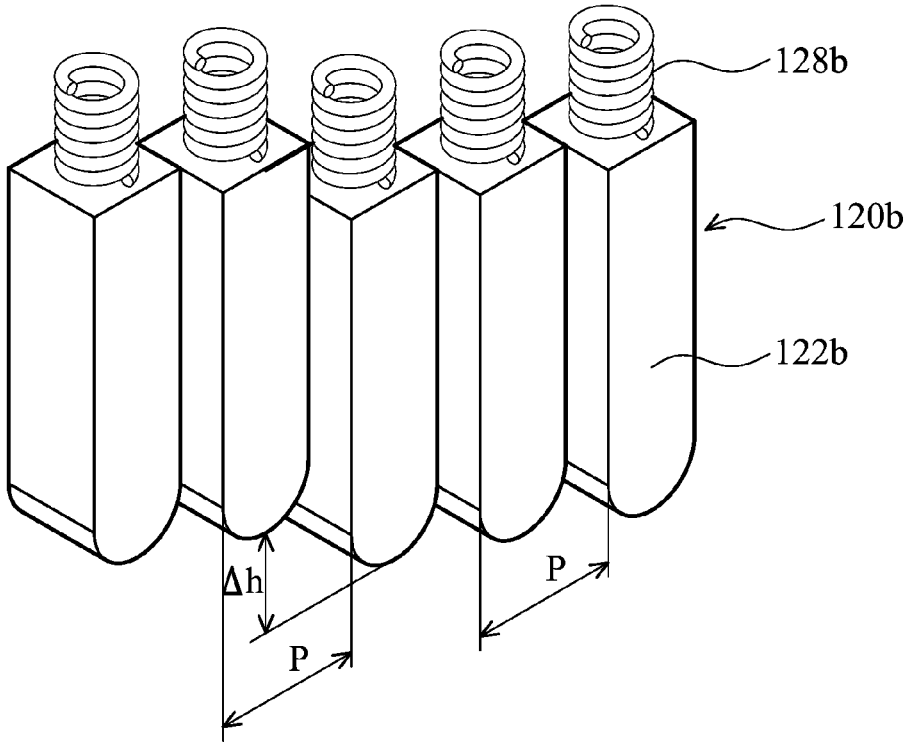
FIG. 3C is a schematic view of another embodiment of a thermal print head module of the invention.

FIG. 3A is a schematic view of an embodiment of a thermal print head module of the invention. FIG. 3B is a cross section of the thermal print head module of FIG. 3A. Referring to FIG. 3A, a thermal print head module 120*a* is equipped with at least one point thermal heater 122. According an embodiment of the invention, the thermal print head module 120*a* is equipped with a plurality of heaters. The plurality of heaters is arranged linearly. Alternatively, the plurality of heaters is arranged in a matrix form, however is not limited thereto, the plurality of heaters can also be staggered, as shown in FIG. 3C. According to another embodiment of the invention, an elastic adjustable device 128 is disposed overlying the thermal print head module 120*a* to adjust the flatness of the thermal print head module. The elastic adjustable device 128 can be an elastic object to entirely horizontally adjust the thermal print head module. Referring to FIG. 3B, between two adjacent heaters, there is a predetermined gap 123. The sum of the width of a heater and the gap 123 is referred as a pitch P. The pitch P is in a range between about 10 μm and 2000 μm.

FIG. 3C is a schematic view of another embodiment of a thermal print head module of the invention. In FIG. 3C, the hearers in a thermal print head module 120*b* are independent from each other. The elastic adjustable device comprises a plurality of elastic objects 128*b* corresponding to the heaters 122*b*, respectively. Each elastic objects 128*b* can adjust horizontal and flatness of the respective heater 122*b*. For example, when a height difference Δh exists between adjacent heaters, the elastic objects 128*b* can automatically adjust each heaters 122*b* respectively such that the contact faces between the heaters 122*b* and the desirable patterning substrate are completely flattened.

Figure 4:
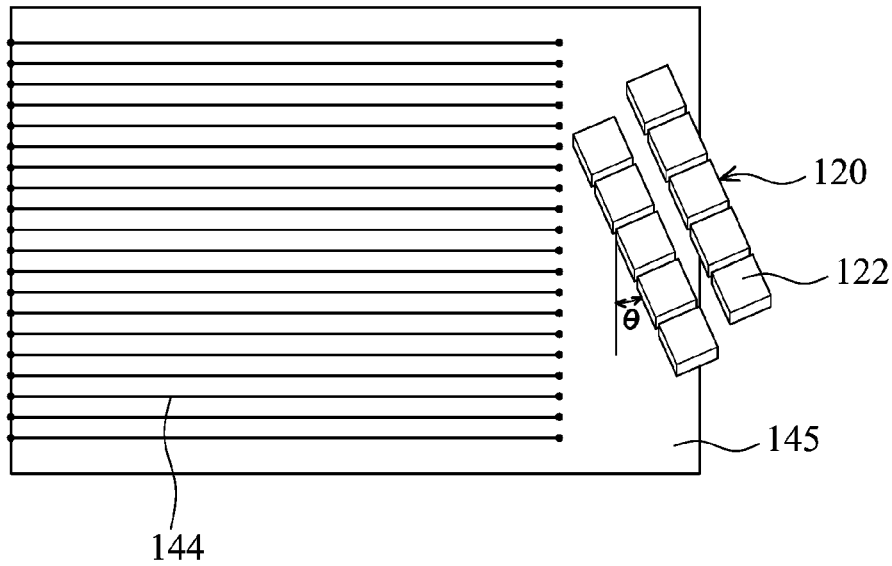
FIG. 4 is a schematic view of another embodiment of a thermal print head module of the invention.

FIG. 4 is a schematic view of another embodiment of a thermal print head module of the invention. When the pitch P of the heaters 122*b* is greater than an interval between desirable thermal patterning patterns 144, the thermal print head module can be rotated with a predetermined angle θ by a rotation adjustable device 126 (as indicated in FIG. 2) such that projection of the pitch between each heater and each pitch along a moving direction is equal to an interval between desirable thermal patterning patterns 144.

Note that the abovementioned embodiments of the invention adopt thermal writing techniques to create fabrication methods that result in fast production, high efficiency, excellent quality, controlled and stable heating, and large-scale applicability. The fabrication methods for patterned structures using thermal writing techniques are applicable and compatible to automatic roll-to-roll processes.

Figure 5:
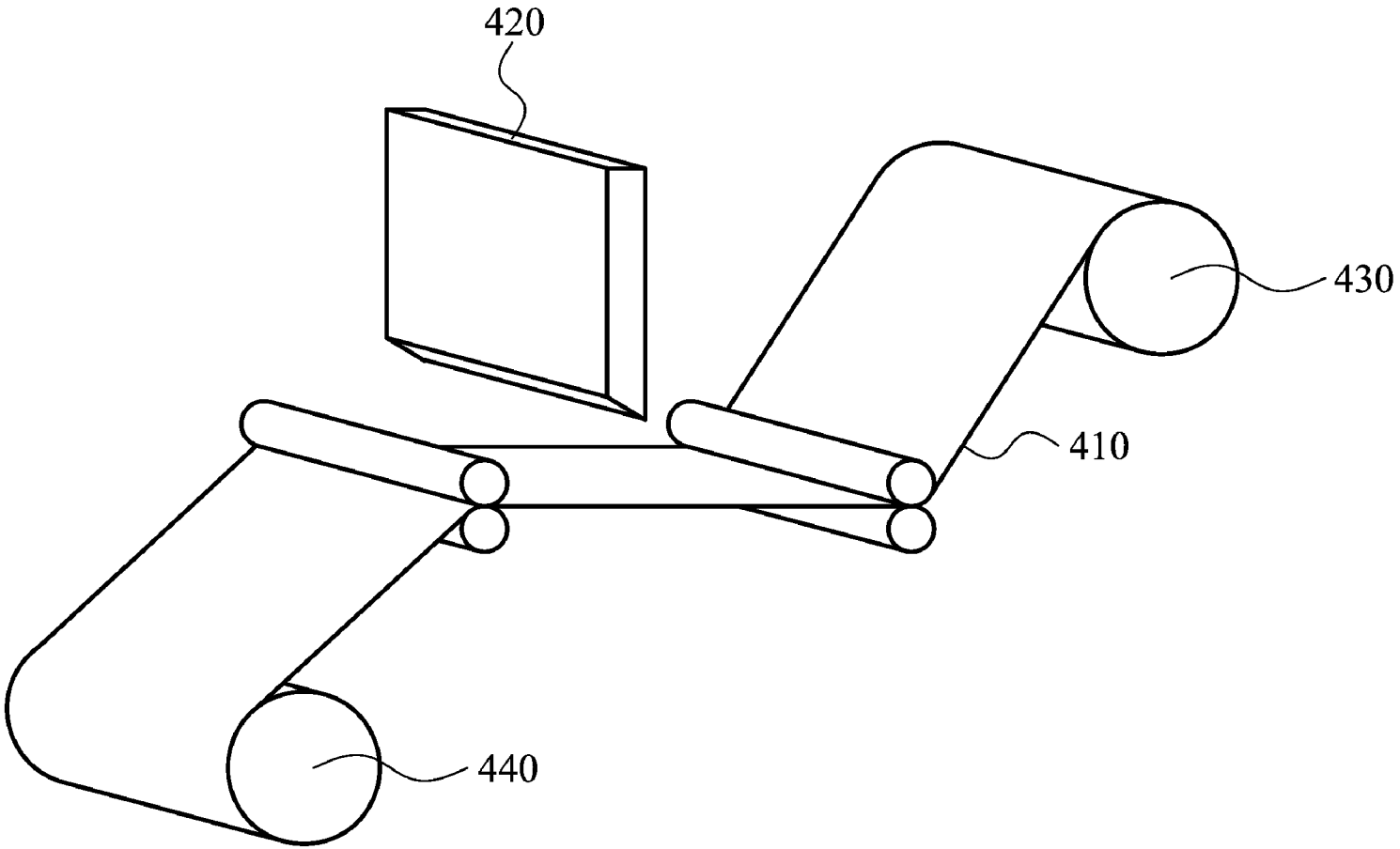
FIG. 5 is a schematic view of an embodiment of a roll-to-roll process of the invention.

FIG. 5 is a schematic view of an embodiment of a roll-to-roll process of the invention. Referring to FIG. 5, a flexible substrate 410 such as a polymer substrate is provided from a roller 430 to a roller 440. A thermal writing head module 420 is fixed and positioned above the flexible substrate 410. The conveying speed from the roller 430 to the roller 440 can be controlled to achieve continuous large-scale roll-to-roll fabrication of the patterned structures.

According to embodiments of the invention, the thermal writing techniques using the multiple thermal writing head are advantageous, in that heating energy is concentrated and stable and material characteristics are able to be controlled. Thus, the embodiments are applicable to fabrication of 3D phase retarders, ITO electrode substrates, and photoresists on flexible substrates. Specifically, problems associated with conventional laser scanning, such as low production throughput and pattern quality deficiencies can be mitigated. Moreover, fabrication using the thermal writing techniques of the invention can be used to replace the conventional lithography process, as photoresists can be directly transferred onto flexible substrates using thermal writing techniques of the invention.

Figure 6A:
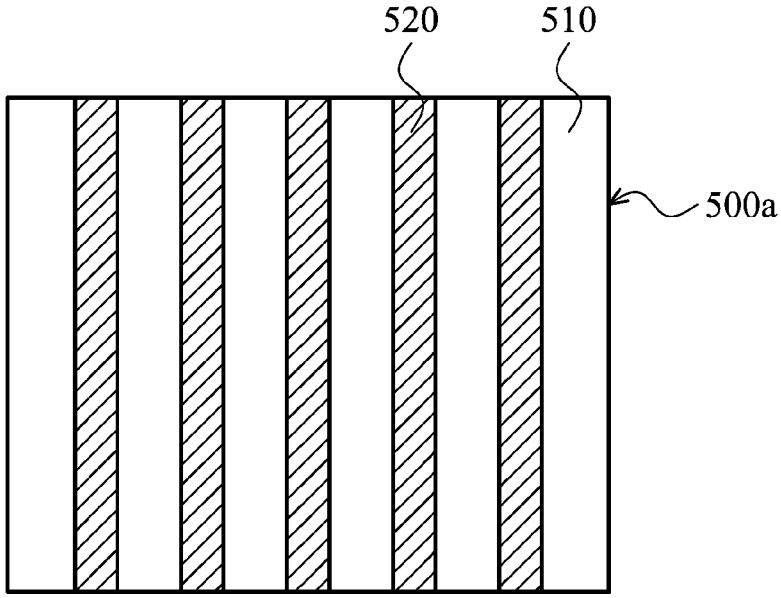
FIGS. 6A and 6B are schematic views showing fabrication of a 3D phase retarder using the thermal patterning system of FIG. 2.
Figure 6B:
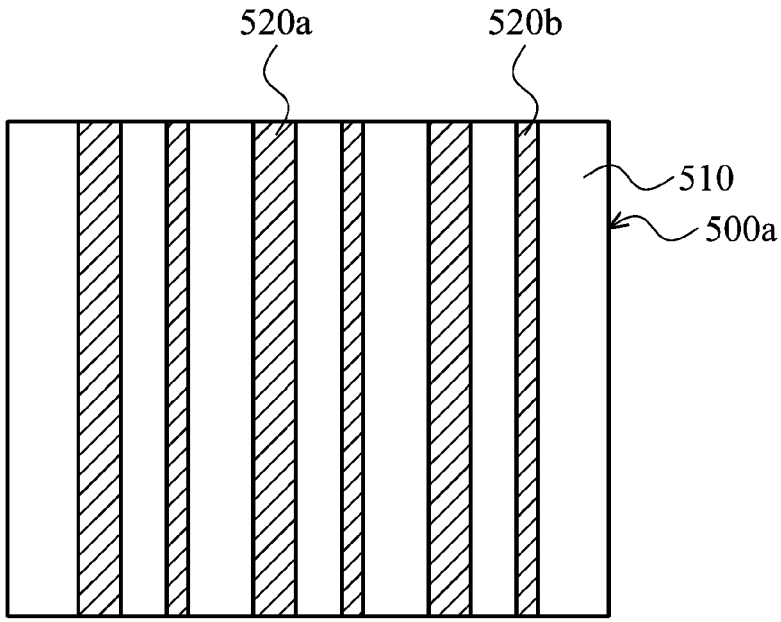

FIGS. 6A and 6B are schematic views showing fabrication of a 3D phase retarder using the thermal patterning system of FIG. 2. Referring to FIG. 6A, a desired patterned film (such as a polymer film) 500*a* is patterned by using a multiple thermal writing head to create a patterned region 520 and a non-patterned region 510. The patterned structure can serve as a 3D phase retarder. The patterned region 520 can be periodic stripe patterns. The patterned region 520 can also include alternating strips 520*a* and 520*b* with different line widths, as shown in FIG. 6B. Alternatively, the patterned region 520 can be other geographic shapes, such as grid patterns.

Figure 7A:
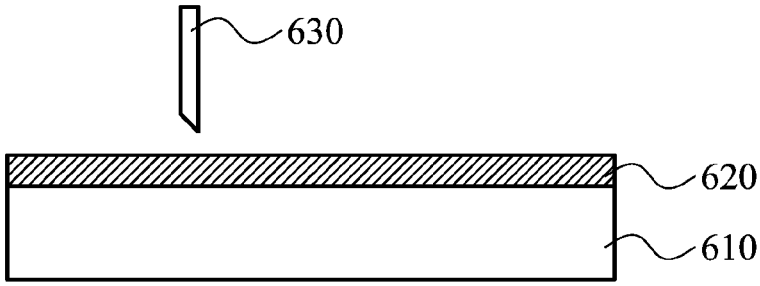
FIGS. 7A-7C are cross sections illustrating fabrication of an ITO electrode substrate using the thermal patterning system of FIG. 2.
Figure 7B:
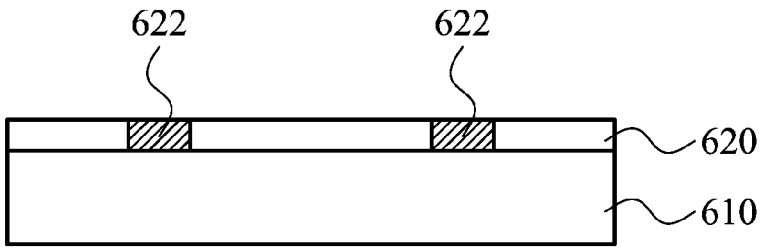
Figure 7C:
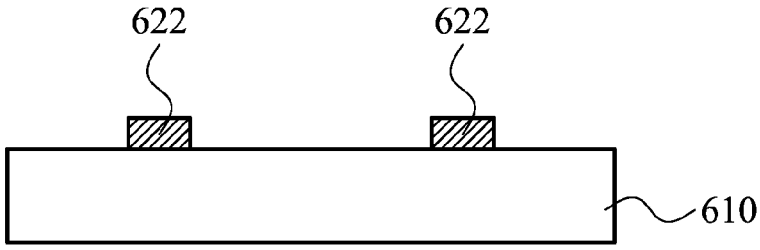

FIGS. 7A-7C are cross sections illustrating fabrication of an ITO electrode substrate using the thermal patterning system of FIG. 2. Referring to FIG. 7A, a substrate 610 is provided. An ITO electrode layer 620 is formed on the substrate 610. The multiple thermal writing head 630 moves from one end (e.g., the left end) of the substrate 610 to the other end (e.g., the right end), thereby creating a patterned ITO electrode region. For example, the ITO layer is heated and transformed into a crystallized ITO electrode 622, as shown in FIG. 7B.

Referring to FIG. 7C, the non-patterned ITO electrode region 620 is then removed leaving the patterned ITO electrode region 622, thereby completing fabrication of the tin indium oxide (ITO) electrode substrate.

While the invention has been described by way of example and in terms of the embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for thermal patterning, comprising:

a thermal print head module equipped with a plurality of heaters;

an elastic adjustable device for adjusting the flatness of the thermal print head module; and a rotation adjustable device for controlling the thermal print head module to rotate with a predetermined angle, wherein the elastic adjustable device comprises a plurality of elastic objects corresponding to the heaters, respectively.

2. The system for thermal patterning as claimed in claim 1, wherein the plurality of heaters are arranged linearly.

3. The system for thermal patterning as claimed in claim 1, wherein the plurality of heaters are arranged in a matrix form.

4. The system for thermal patterning as claimed in claim 1, wherein between two adjacent heaters, there is a predetermined pitch.

5. The system for thermal patterning as claimed in claim 4, wherein the pitch is a range between about 10 μm and 2000 μm.

6. The system for thermal patterning as claimed in claim 4, wherein the rotation adjustable device controls rotation of the thermal print head module such that projection of the pitch between each heater and each pitch along a moving direction is equal to an interval between desirable thermal patterning patterns.

7. A system for thermal patterning, comprising:

a thermal print head module encapsulating a passivation layer, wherein the thermal print head module is equipped with a plurality of heaters;

an elastic adjustable device for adjusting the flatness of the thermal print head module; and a rotation adjustable device for controlling the thermal print head module to rotate with a predetermined angle, wherein the elastic adjustable device comprises a plurality of elastic objects corresponding to the heaters, respectively.

8. The system for thermal patterning as claimed in claim 7, wherein the plurality of heaters are arranged linearly.

9. The system for thermal patterning as claimed in claim 7, wherein the plurality of heaters are arranged in a matrix form.

10. The system for thermal patterning as claimed in claim 7, wherein between two adjacent heaters, there is a predetermined pitch.

11. The system for thermal patterning as claimed in claim 7, wherein the pitch is a range between about 10 μm and 2000 μm.

12. The system for thermal patterning as claimed in claim 7, wherein the rotation adjustable device controls rotation of the thermal print head module such that projection of the pitch between each heater and each pitch along a moving direction is equal to an interval between desirable thermal patterning patterns.

13. The system for thermal patterning as claimed in claim 7, further comprising:

a supporting stage disposed on a base, wherein the supporting stage controls movement of a thermal patterning platform by using a precise bearing motor;

a working piece to be patterned fixed onto the thermal patterning platform;

two vertical shafts fixed with a transverse beam, wherein the transverse beam is fixed by a height adjustable means; and a thermal print head module setup and fixed to underly the transverse beam, thereby micro-contacting the working piece.

14. The system for thermal patterning as claimed in claim 13, further comprising a microprocessor and a controller to control output of the thermal print head module.

* * * * *